United States Patent [19]

Gruesbeck et al.

[11] 4,046,198

[45] Sept. 6, 1977

[54] METHOD AND APPARATUS FOR GRAVEL PACKING WELLS

[75] Inventors: Clay Gruesbeck; William M. Salathiel; Thomas W. Muecke; Claude E. Cooke, Jr., all of Houston, Tex.

[73] Assignee: Exxon Production Research Company, Houston, Tex.

[21] Appl. No.: 661,662

[22] Filed: Feb. 26, 1976

[51] Int. Cl.[2] ..... E21B 33/00; E21B 43/04

[52] U.S. Cl. ..... 166/278; 166/51; 166/236

[58] Field of Search ..... 166/278, 276, 51, 228, 166/236, 280

[56] References Cited

U.S. PATENT DOCUMENTS

| | | | |
|---|---|---|---|
| 2,905,245 | 9/1959 | De Priester | 166/278 X |
| 2,942,664 | 6/1960 | Burns | 166/51 |
| 3,153,451 | 10/1964 | Chancellor et al. | 166/51 |
| 3,637,010 | 1/1972 | Maly et al. | 166/51 |
| 3,913,675 | 10/1975 | Smyrl | 166/278 |
| 3,913,676 | 10/1975 | Barbee, Jr. et al. | 166/278 |

*Primary Examiner*—Stephen J. Novosad
*Assistant Examiner*—George A. Suchfield
*Attorney, Agent, or Firm*—Salvatore J. Casamassima

[57] ABSTRACT

The annular passage defined by the interior of a perforated liner and the exterior of a stinger pipe extending through the liner is substantially restricted so that the resistance to flow in the annular passage is increased sufficiently to maintain high fluid flow velocity outside the liner during gravel packing. The increased flow velocity prevents the premature settling of gravel and stabilizes the formation of gravel dunes in the wellbore annulus, thereby significantly increasing gravel packing efficiency in inclined wells. The proper flow restriction can be obtained using a wide diameter stinger pipe.

7 Claims, 2 Drawing Figures

METHOD AND APPARATUS FOR GRAVEL PACKING WELLS

BACKGROUND OF THE INVENTION

1. Field of the Invention

This invention relates to the completion of wells in subterranean formations, In one aspect it relates to an improved method and apparatus for gravel packing the annulus surrounding a liner placed in a well.

2. Description of the Prior Art

A major problem in completing wells in unconsolidated or loosely consolidated formations is sand control. Sand particles entrained in produced fluids can plug the flow channels of the formation and can cause severe erosion of well equipment such as liners, the producing string, valves and pumps. A well known sand control technique is gravel packing, whereby properly sized gravel is placed opposite the unconsolidated formation, forming a sand exclusion zone which filters out the sand particles entrained in the produced fluid.

A conventional gravel packing technique involves locating a perforated liner at a subsurface location in the well and therafter placing gravel around the liner. Normally, a slurry of gravel suspended in a liquid carrier is pumped into the annular space between the formation wall and the liner. Ideally, as the suspension reaches the bottom of the annulus the gravel is compactly deposited in the annulus on the exterior of the liner and the liquiid carrier withdraws through the liner perforations and back up the casing string. In this manner, the gravel uniformly builds up until the entire annulus surrounding the liner is filled.

A problem encountered with this technique arises when the well-bore deviates from the vertical. When the well is inclined, the gravel fails to pack uniformly, resulting in voids within the packed annulus which weaken the pack and permit the production of sand entrained fluids. It is believed that the main reason for the occurrence of this problem is that the gravitational forces in such wells tend to cause the gravel to prematurely settle out near the upper end of the liner. As a result, a small gravel bank, referred to herein as a dune, begins to form within the upper end of the annulus. As the dune grows and descends down the annulus, more and more of the carrier liquid is diverted through the liner upstream of the dune thereby causing the velocity of the gravel suspension to decline. As velocity drops, the carrier liquid can no longer suspend the gravel with the result that additional gravel settles out until the dune completely blocks flow to the lower portions of the annulus. Substantially all of the carrier liquid is then diverted into the upstream section of the liner causing the upper section of the annulus to pack while leaving a substantial void space in the lower section. In practice, a number of gravel dunes and void spaces may be formed in the manner described above.

In order to uniformly and compactly fill the annulus surrounding a liner in an inclined wellbore, the upper flow channel must remain open until the lower section of the annulus is filled. In efforts to achieve this, a conventional approach involves the use of a small diameter tube, referred to herein as a stinger pipe or stinger, positioned through the liner, which serves as the return conduit for the carrier liquid. The carrier liquid must flow down to the bottom of the liner before passing back up through the stinger. This downward directional flow tends to force the gravel suspension to the bottom of the wellbore annulus. Stinger performance, however, is generally poor in inclined wellbores, especially when the liner is long or when the wellbore incline is steep.

One approach to improving gravel packing efficiency is to improve stinger design. An improved stinger design, as decribed by Maly and Robinson in U.S. Pat. No. 3,637,010, is the baffled stinger. Deformably radial baffles are mounted on the stinger along its length and are sized so as to provide several longitudinally spaced seals between the stinger and the liner. The baffles, positioned in this manner, prevent carrier liquid from flowing into the upper portions of the liner, thereby forcing all liquid suspension down the annulus to the base of the liner. A sufficiently high flow velocity of the gravel suspension within the annulus is maintained to prevent the formation of dunes. As the annulus fills with gravel, the carrier liquid is diverted through the liner perforations until the gravel within the annulus builds up past a baffle. At this point the differential pressure across the baffle increases sufficiently to deform the baffle causing it to be downwardly cupped, thus opening a flow passage to the bottom of the stinger and allowing liquid to flow past the baffle. Baffled stingers, however, introduce other problems. The mounted baffles are costly, they impede free movement or rotation of the stinger, and they are not universally effective in arresting dune formation especially in wells inclined at steep angles.

SUMMARY OF THE INVENTION

The problem of dune formation in inclined wells is substantially eliminated by the present invention. In accordance with the invention, the annular passage between the interior of a perforated liner and a stinger positioned through the liner is substantially restricted. It has been found that such a restriction significantly increases gravel packing efficiency in inclined wellbores.

The flow restriction between the liner and stinger can be achieved by using a wide diameter stinger. A wide diameter stinger positioned in the liner decreases the cross sectional area of the annular passage between the stinger and the liner, thereby restricting the flow of carrier liquid in the passage. The decreased area available for fluid flow within the annular passage increases the resistance to flow and decreases the flow of carrier liquid into the liner.

The amount of flow restriction, however, is critical. The diameter of the stinger must be large enough to increase the resistance to flow in the annular passage sufficiently to maintain the minimum flow velocity of carrier liquid about the exterior of the liner that is necessary to prevent dune formation near the upper portions of the liner. For most gravel packing operations, the resistance to flow in the annular passage should be at least 0.12 pounds per square inch per foot of length of liner in vertical or slightly deviated wells and 0.24 pounds per square inch per foot of length of liner in highly deviated. To attain such a pressure differential, the outside diameter of the stinger should not be less than about 75 percent of the inside diameter of the liner and, in some instances, may be more than 90 percent of the liner diameter.

It is not possible, however, to completely quantify and generalize the relationship between stinger diameter and inside liner diameter. The amount of flow restriction necessary to prevent dune formation as expressed by the ratio of stinger diameter to liner diameter will be a function of a number of parameters such as wellbore incline angle, gravel concentration, gravel particle size and shape, carrier liquid density and viscosity, and the diameters of the liner and wellbore. Laboratory experiments and mathematical correlations may have to be employed to determine the proper stinger diameter for the particular gravel packing system which is required.

DESCRIPTION OF THE PREFERRED EMBODIMENT

Figure 1:
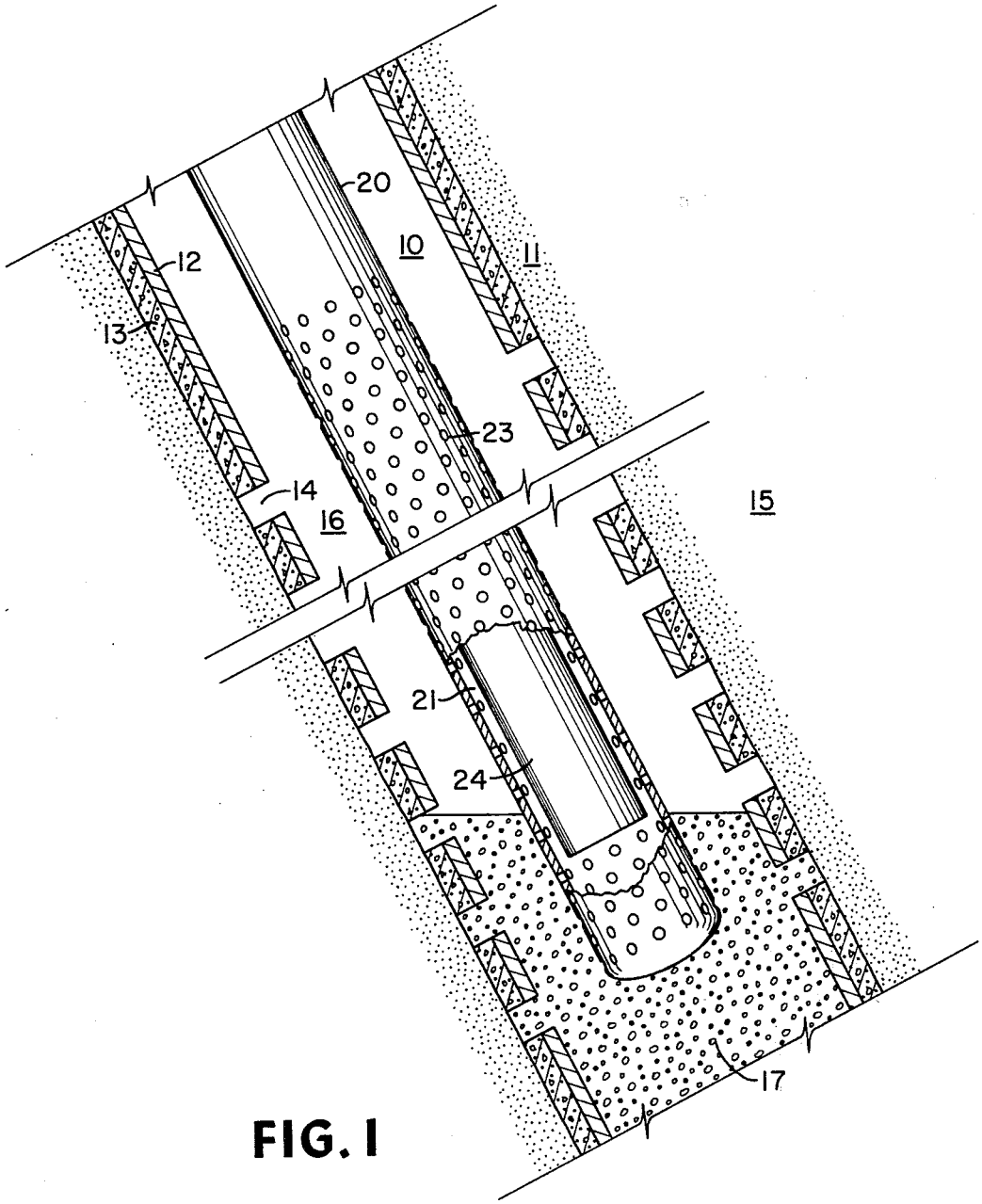
FIG. 1 is a schematic of a liner having a wide diameter stinger inserted therein.

With reference to FIG. 1, an inclined wellbore 10 penetrates a subterranean producing formation 11. A well casing 12 which extends through the well and is held in place by cement 13, is provided with perforations 14 in the producing zone 15. A lower portion of wellbore 10 may be enlarged in the perforated interval to provide a larger borehole in the producing zone 15 to be gravel packed.

Perforated liner 20 is placed in the wellbore 10 opposite producing zone 15. An annular space 16 defined by the liner 20 and casing 12 is the area which is to be packed with gravel. For purposes of the present discussion, the terms "liner" or "perforated liner" as used herein refer to a wide range of tubular subsurface devices used in wells. Such devices are referred to in the art as "preperforated liners," "vertically slotted liners," "horizontally slotted liners," "screens," "prepacked screens," "wire wrapped screens" and the like. The term "gravel", as used herein, refers to any granular or aggregate material used for filtering purposes in subsurface wells.

The gravel may be deposited using a conventional gravel packing technique. However, it should be noted that this method applies equally well to open hole gravel packs. The liner 20 is lowered into the wellbore 10 on the well tubing string (not shown) which normally includes a crossover tool (not shown). Gravel and a carrier liquid, normally water, are mixed to form a gravel suspension which is then pumped through the tubing, crossing over to the outside of liner 20. The gravel 17 is deposited within the annular space 16. Carrier liquid enters liner 20 through perforations 23 and flows down the inside of liner 20 and into the lower end of stinger 24, located within the liner, and from there to the surface. Sufficient gravel is deposited in this manner until the entire liner 20 is packed. Produced fluids can then flow freely from the producing zone 15 through the gravel 17 into liner 20.

In accordance with the present invention, the gravel can be more compactly and uniformly packed by substantially restricting the annular passage 21 defined by the interior 22 of liner 20 and stinger 24. Flow restriction is more readily achieved by using a wide diameter stinger 24. The restricted annular passage 21 increases the resistance to flow within the passage, thereby decreasing the flow of carrier liquid into liner 20.

Laboratory tests have shown that the invention as described above significantly improves gravel packing efficiency. However, the amount of flow restriction of the annular passage between the stinger and the interior of the liner is critical in obtaining good results. This was determined by experiments which were conducted in a transparent wellbore model containing a 10 foot long, wire wrapped liner. The model was inclined 90 degrees from the vertical.

Tests were performed using tap water as the carrier liquid. Two sets of runs were performed in which the gravel in water slurry had a gravel concentration of 0.5 lb/gal in the first set and 1.0 lb/gal in the second set. The slurry was pumped at an annular velocity of 1 ft/sec through the linercasing annulus. The inside diameter of the wire wrapped liner was kept constant at 1.024 inches. Stinger diameter was varied for each run. Tests were run using stinger diameters of 0.0 (no stinger), 0.5, 0.6, 0.7, 0.814 and 0.924 inches.

Figure 2:
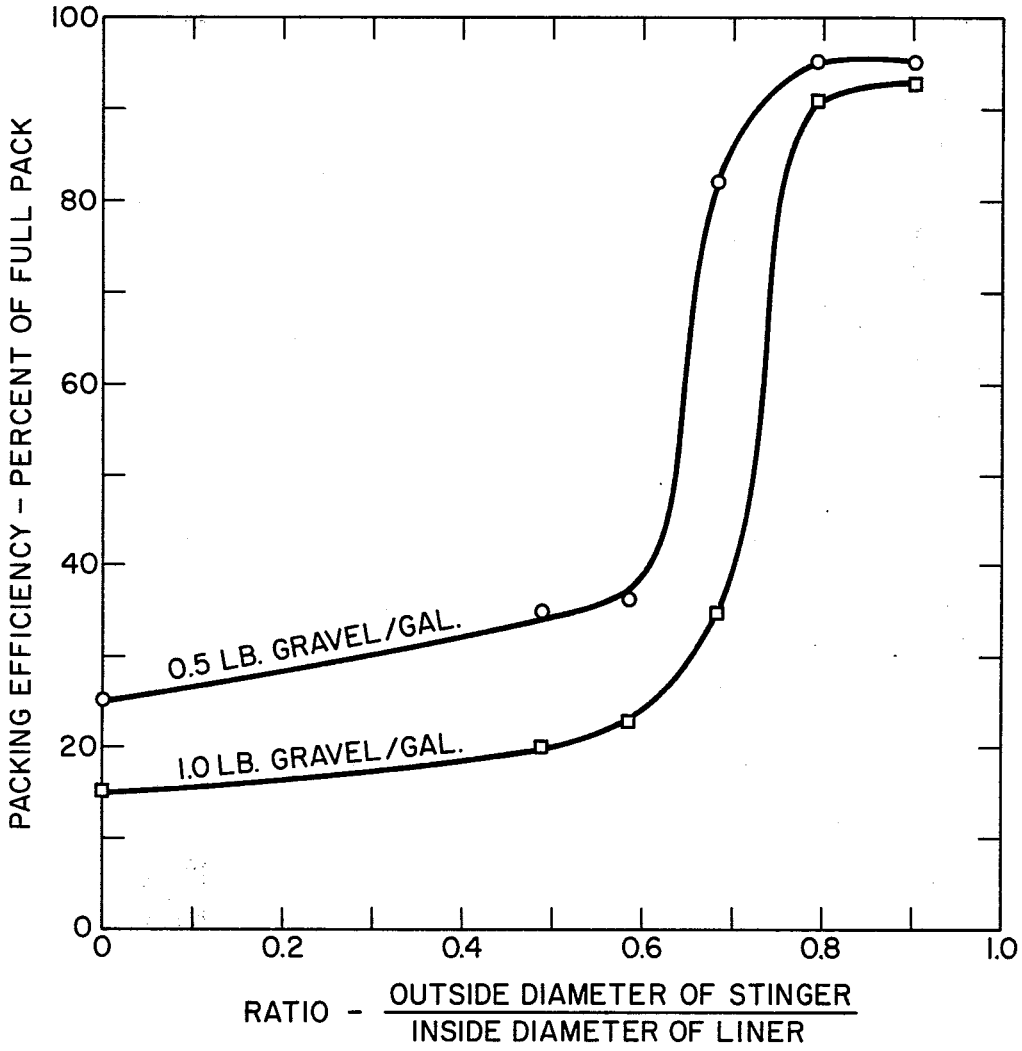
FIG. 2 is a plot of packing efficiency versus the ratio of stinger diameter to liner diameter for two gravel packing systems.

The results of the test are shown in FIG. 2 which is a plot of packing efficiency versus the ratio of the outside diameter of the stinger to the inside diameter of the liner. For both sets of runs, gravel packing efficiency is poor until a ratio of about 0.6 is reached. At that point packing efficiency dramatically increases. About 900 to 95 percent packing efficiency is attained at a ratio of about 0.80. Thus a one third increase in stinger diameter resulted in a 57 percent increase in packing efficiency for the 0.5 lb/gal system and a 70 percent increase for the 1.0 lb/gal system. The reason for this sudden increase in packing efficiency at a stinger diameter to liner diameter ratio of about 0.60 is not readily explained.

Once a dune begins to build it will continue to grow if the downward drag force of the carrier liquid on the gravel particle does not exceed the settling forces on the particle. It has been experimentally observed that dune formation can be arrested if the drag force exerted on the last gravel particles that have settled is sufficient to fluidize those particles so that they saltate or "leapfrog" along the top of a partially formed dune. This process of saltation allows a continuous transport of gravel particles to the base of the wellbore, thereby permitting uniform packing of the gravel. The partially formed dune, which is called a stabilized bed, will not grow any further so long as saltation continues.

To impact sufficient drag force on the gravel particles to achieve saltation it is necessary to attain a sufficient velocity of the carrier liquid. As noted before, particle settling velocity in steeply inclined wells is not helpful in directing gravel to the base of the wellbore. Hence, the flow of the carrier liquid must impart most of the drag force on the gravel particles. The minimum velocity of carrier liquid in the wellbore annulus at which saltation occurs will be referred to herein as the critical velocity.

Below a stinger diameter to liner diameter ratio of about 0.60, saltation does not occur because carrier liquid escaping into the liner reduces the velocity of the carrier liquid on the exterior of the liner to below the critical velocity. Dune formation, therefore proceeds unabated. Beyond a ratio of about 0.60, incipient gravel fluidization and saltation begins to occur, indicating that the critical velocity has been exceeded. At this point, packing efficiency rapidly increases. Experiments with a transparent wellbore model indicate that dune formation is arrested at an early stage at ratios beyond about 0.75. Beyond this ratio, gravel packing efficiency generally exceeds 90 percent.

It is not possible, however, to characterize stinger design entirely in terms of the ratio of stinger diameter to liner diameter. Other parameters such as wellbore incline angle, gravel concentration, gravel particle size and shape, carrier liquid density and viscosity, and the diameters of the liner and wellbore will affect the particular stinger diameter desired. For example, the above stinger to liner ratios were based on experiments using water as a carrier liquid and inclining the wellbore a full 90 °from the vertical to horizontal position. If, however, a more viscous carrier liquid having good particle suspension properties was used or if the wellbore incline was not as steep, then a somewhat different indication of the proper ratio would have been obtained.

One technique which gives a reasonably reliable indication of the proper stinger diameter to select involves calculating the resistance to flow in the annulus between the stinger and liner. It appears that there is a close correlation between the resistance to flow in the annulus and gravel packing efficiency. The correlation arises because a high flow resistance in the annulus between the liner and the stinger prevents carrier liquid from readily entering the liner. Thus, the carrier liquid can be maintained at a sufficiently high velocity to prevent dune formation.

Table I shows the correlation between the stinger to liner ratio, packing efficiency and flow resistance. Flow resistance is indicated in terms of pressure drop per foot and was calculated using the Fanning equation for flow in an annulus. (See Perry's Chemical Engineer's Handbook, Fifth Edition, p. 520 ff.) The packing efficiencies were obtained from the previously discussed gravel packing experiments depicted in FIG. 2.

TABLE I

| Ratio of Stinger O.D. to Liner I.D. | Flow Resistance (psi/ft) | Percent Packing Efficiency at Gravel Concentration of 0.5 lb/gal | 1.0 lb/gal |
|---|---|---|---|
| 0.0 (no stinger) | | 25 | 18 |
| 0.488 | 0.032 | 35 | 20 |
| 0.585 | 0.050 | 38 | 22 |
| 0.683 | 0.089 | 82 | 35 |
| 0.793 | 0.24 | 95 | 92 |
| 0.901 | 0.73 | 95 | 95 |

Table I shows that in order to efficiently pack gravel in a highly deviated well, the flow resistance inside the annulus formed by the stinger and liner should be about 0.24 psi/ft or higher. Such a flow resistance will normally result in a packing efficiency exceeding 90 percent. Experiments with less deviated wellbore angles (e.g., under 45 ° incline) indicate that the flow resistance should be no less than about 0.12 psi/ft.

It is, therefore, possible to calculate the desired stinger diameter if all other variables are known. But substituting the desired flow resistance in the Fanning equation, the proper stinger diameter can be calculated.

More sophisticated design correlations can be developed with the aid of regression analysis. For example, the critical velocity of the carrier liquid necessary to stabilize dune formation can be determined in a series of experiments in which other parameters are varied. The critical velocity can then be mathematically correlated with a dimensionless function of the varied parameters. Once such a correlation is established the critical velocity can be determined for a given gravel packing system. Knowing the critical velocity, the pressure drop in the flow channel above the stabilized bank can be calculated. This pressure drop will be equal to the pressure drop in the annulus between the stinger and the liner and represents the resistance to flow in the annulus. By substituting the pressure drop in the Fanning equation, the stinger diameter can then be determined.

Note that this correlation technique permits the computation of the smallest flow resistance in the stinger-liner annulus which is necessary to stablize dune formation. Thus the Fanning equation, using that flow resistance, will yield the minimum stinger diameter needed to achieve efficient packing. This technique offers a more precise way of determining proper stinger diameter than the previously described method in which a flow resistance above 0.24 psi/ft for highly deviated wells or 0.12 psi/ft for less deviated wells is somewhat arbitrarily selected.

EXAMPLE I

Recommended stinger diameters for use in highly deviated wells were calculated using a selected pressure drop of 1.0 psi/ft in the stingerliner annulus. This was considered a sufficient flow resistance to achieve a packing efficiency of about 95 percent in highly deviated wells. Given the flow resistance of 1.0 psi/ft, the stinger diameters corresponding to various liner diameters were calculated using the Fanning equation for flow in an annulus. Water, having a viscosity of 1 centipoise and a flow rate of 2 barrels per minute, was selected as the carrier liquid. Table II summarizes the calculations. Next to each recommended stinger diameter is the conventional stinger diameter currently employed in actual field use.

TABLE II

| Liner Diameter (I.D. - inches) | Stinger Diameter (O.D. - inches) Recommended | Conventional |
|---|---|---|
| 1.995 | 1.550 | 1.315 |
| 2.441 | 2.063 | 1.660 |
| 2.922 | 2.600 | 1.900 |
| 4.408 | 4.158 | 2.375 |

EXAMPLE II

Experiments were conducted using the previously described transparent wellbore model in which the critical velocity necessary to stabilize dune formation was measured for various systems. The experiments involved altering key variables such as liner diameter, carrier liquid density and viscosity, gravel particles size and density, and gravel concentration in the carrier liquid. A total of 56 data points were generated which were then correlated with the critical velocity by a computer assisted regression analysis. The correlation developed was:

$$\text{Critical Velocity} = 14.99\ U_s Re_l^{0.388} Re_p^{-0.731} \rho_D^{.171}\ C^{0.138}$$

In this equation $U_s$ is the terminal settling velocity of the gravel particles, $Re_l$ is the Reynolds number for the systems, $Re_p$ is the Reynolds number for the gravel particles, $\rho_D$ is a dimensionless number expressing the density difference between the carrier liquid and the particles, and C is the volume fraction occupied by the gravel particles in the carrier liquid. More specifically:

$$Re_l = \frac{D_L U_s \rho}{\mu};\ Re_p = \frac{d_p U_s \rho}{\mu};\ \rho_D = \frac{\rho_p - \rho}{\rho};$$

where:

$D_L$ = hydraulic radius of open flow channel in wellbore $d_p$ = diameter of gravel particle $\mu$ = viscosity of carrier liquid $\rho$ = density of carrier liquid $\rho_p$ = density of gravel particle Using the above correlation equation, the critical velocity was calculated for a system in which the following variables are known:

Liner — inside diameter: 1.024 inches
Casing — inside diameter: 2.50 inches
Gravel — particle diameter: 20–40 mesh range
particle density: 2.6 g/cc
concentration: 1.0 lbs/gallon of carrier liquid
Carrier Liquid — Tap Water at 70° F (1 centipoise, 1 g/cc)
— Flow Rate: 6.4 gallons per minute The calculated critical velocity at equilibrium was 3.4 ft/sec.

It is now necessary to equate the pressure drop in the open flow channel surrounding the outside of the liner with the pressure drop in the annulus between the liner and the stinger using the proper Fanning formulas. However, if the amount of dune formation is not known, it is only possible to obtain the pressure drop in the channel surrounding the liner as a function of the percentage of the wellbore channel which is open to flow. The solution, in such a case, is the lowest pressure drop at which the two Fanning formulas will equate. That is, the system will seek the path of least resistance. This would be the minimum flow resistance necessary to achieve dune stabilization.

The minimum flow resistance for the given system corresponds to a pressure drop of 0.24 psi/ft and a stinger diameter of 0.80 inches. This is the minimum stinger diameter which will permit efficient gravel packing for the variables selected. A conventional stinger diameter would be about 0.65 inches.

Examples I and II indicate that the stingers currently used by industry are much narrower than those which are necesary to achieve efficient gravel packing in highly deviated wells. Conventional stingers fail to create the flow resistance which is required to arrest dune formation during the gravel packing of deviated wells.

There are many possible ways to adjust the clearance between the stinger and the liner to achieve proper flow restriction. The simplest is to use a stinger having the proper diameter. However, a conventional stinger can be rendered suitable for gravel packing deviated wells by increasing its diameter with a metallic or plastic sleeve or by coating it with a suitable material.

The principle of the invention and various modifications and embodiments have been described. It should be realized that the foregoing is illustrative only and that other means and techniques can be employed without departing from the scope of the claimed invention.

We claim:

1. In a method of gravel packing a perforated liner opposite a subterranean formation in a well wherein a carrier liquid having gravel suspended therein is flowed downwardly along the outside of said liner and upwardly through a stinger pipe which extends substantially through the entire length of said liner, the improvement comprising said stinger pipe having an outside diameter large enough to substantially restrict the annular passage defined by said stinger and the interior of said liner so that the resistance to flow in said annular passage is increased sufficiently to maintain at least the minimum flow velocity of said carrier liquid along the outside of said liner necessary to prevent the premature settling of said gravel and formation of gravel dunes near the upper portions of said liner.

2. The method as defined in claim 1 wherein the outside diameter of said stinger pipe is not less than about 75 percent of the inside diameter of said liner.

3. The method as defined in claim 1 wherein the outside diameter of said stinger pipe is made large enough to substantially restrict said annular passage by attaching a sleeve to the exterior of said stinger.

4. In a method of gravel packing a perforated liner opposite a subterranean formation in a well wherein a carrier liquid having gravel suspended therein is flowed downwardly along the outside of said liner and upwardly through a stinger pipe which extends substantially through the entire length of said liner, the improvement comprising:

longitudinally restricting the annular passage defined by the exterior of said stinger pipe and the interior of said liner so that the resistance to flow in said annular passage is increased sufficiently to maintain at least the minimum flow velocity of said carrier liquid along the outside of said liner necessary to prevent the premature settling of said gravel near the upper portions of said liner.

5. In a method of gravel packing a perforated liner opposite a subterranean formation in a well wherein a carrier liquid having gravel suspended therein is flowed downwardly along the outside of said liner and upwardly through a stinger pipe which extends substantially through the entire length of said liner, the improvement comprising:

adjusting the clearance between said stinger pipe and said liner such that the resistance to flow in the annular passage defined by the exterior of said stinger pipe and the interior of said liner is sufficient to maintain at least the minimum flow velocity of said carrier liquid along the outside of said liner necessary to prevent premature settling of said gravel formation of gravel dunes near the upper portions of said liner.

6. An improved apparatus for gravel packing wells of the type having a perforated liner and a stinger pipe which extends substantially through the length of said liner, wherein the improvement comprises said stinger pipe having an outside diameter whhich is not less than 75 percent of the inside diameter of said liner.

7. Apparatus as defined in claim 6 wherein a sleeve is attached to the exterior of said stinger pipe to increase the outside diameter of said stinger.

* * * * *